US011105081B1

(12) United States Patent
Noutsis

(10) Patent No.: US 11,105,081 B1
(45) Date of Patent: Aug. 31, 2021

(54) TABLET DISPENSER FOR SANITIZING A FLUSH TOILET

(71) Applicant: Photios Noutsis, Farmingville, NY (US)

(72) Inventor: Photios Noutsis, Farmingville, NY (US)

( * ) Notice: Subject to any disclaimer, the term of this patent is extended or adjusted under 35 U.S.C. 154(b) by 0 days.

(21) Appl. No.: 17/197,398

(22) Filed: Mar. 10, 2021

(51) Int. Cl.
*E03D 9/00* (2006.01)

(52) U.S. Cl.
CPC ..... *E03D 9/005* (2013.01)

(58) Field of Classification Search
CPC ..... E03D 2009/024; E03D 2009/026; E03D 9/002; E03D 9/005; E03D 9/007; E03D 9/022; E03D 9/033; E03D 9/035; E03D 9/037; E03D 9/032
See application file for complete search history.

(56) References Cited

U.S. PATENT DOCUMENTS 961,650 A * 6/1910 Schellenberg ..... E03D 9/037 4/225.1
1,260,180 A * 3/1918 Gallagher ..... E03D 9/035 4/227.1
2,620,061 A * 12/1952 Uxa ..... A24F 15/16 221/229
3,410,455 A * 11/1968 Haas ..... B65D 83/0418 221/229
3,942,683 A * 3/1976 Haas ..... B65D 83/0418 221/229
3,968,902 A 7/1976 Bachmann
4,171,753 A 10/1979 Vreede
4,480,342 A * 11/1984 Jones ..... E03D 9/038 222/424.5
6,726,058 B2 4/2004 Giraud
7,073,209 B1 * 7/2006 McCormick ..... E03D 9/033 4/227.1
7,934,271 B2 5/2011 Soller et al.
8,146,180 B2 4/2012 Thurin et al.
2018/0305913 A1 10/2018 Ciaccio

FOREIGN PATENT DOCUMENTS

EP 1970496 A2 9/2008
WO 03104086 A2 12/2003
WO 2008145962 A1 12/2008
WO 2016096369 A1 6/2016

* cited by examiner

*Primary Examiner* — Erin Deery
(74) *Attorney, Agent, or Firm* — Carter, DeLuca & Farrell LLP; George Likourezos

(57) ABSTRACT

A dispenser receivable in a toilet tank for automatically dispensing a sanitizing tablet into the toilet tank in response to a toilet flush.

20 Claims, 3 Drawing Sheets

TABLET DISPENSER FOR SANITIZING A FLUSH TOILET

TECHNICAL FIELD

This disclosure relates to a dispenser, and more particularly to a dispenser for dispensing a sanitizing tablet into a toilet.

BACKGROUND

Toilet bowls require care to prevent the buildup of unsightly deposits, to reduce odors, and to prevent the growth of bacteria. Presently, toilet bowls are sanitized, deodorized and/or otherwise cleaned by manual scrubbing with a liquid or powdered cleaning/sanitizing agent that is added to the bowl or tank. This type of cleaning is not only labor intensive, it does not ensure that the toilet bowl or water contained therein is always sanitary after each individual use of the toilet bowl.

Accordingly, there is a continuing need to provide a convenient and effective means for sanitizing a toilet bowl after each use.

SUMMARY

In one aspect, in accordance with the principles of the present disclosure, a dispenser for dispensing a cleaning tablet into a flush toilet is provided and includes a reservoir for holding a plurality of cleaning tablets, a lever having a first end portion and a second end portion, and a float coupled to the second end portion of the lever. The first end portion of the lever is configured to engage an end-most cleaning tablet of the plurality of cleaning tablets and the float is configured to move the lever between a first position and a second position in response to a flushing of the flush toilet. The lever is configured to dispense the end-most cleaning tablet upon moving toward the second position.

In aspects, the first end portion of the lever may support the end-most tablet when the lever is in the first position.

In aspects, the first end portion of the lever may have an edge surface configured to engage and urge the end-most tablet when the lever moves to the second position.

In aspects, the dispenser may further include a biasing member configured to urge the plurality of cleaning tablets toward the first end portion of the lever.

In aspects, the biasing member may be disposed in the reservoir.

In aspects, the dispenser may further include a support wall disposed adjacent a first end portion of the reservoir. The support wall and the first end portion of the reservoir may define a space between the support wall and the first end portion of the reservoir. The space may be configured for receipt of the end-most cleaning tablet.

In aspects, the biasing member and the support wall may be configured to capture the end-most cleaning tablet therebetween to resist the end-most tablet from moving out of the space.

In aspects, the float may have a buoyant force greater than a spring force of the biasing member such that the float is configured to overcome the spring force of the biasing member to urge the end-most tablet out of the space when the float rises with a rising water level in the flush toilet.

In aspects, the lever may be configured to pivot about a pivot axis between the first and second positions.

In aspects, the reservoir may define a longitudinal axis that is parallel with the pivot axis of the lever.

In aspects, the reservoir may define an elongate channel configured for slidable receipt of the plurality of cleaning tablets.

In aspects, the reservoir may define a first opening in communication with the elongate channel. The first opening may be disposed adjacent the first end portion of the lever.

In aspects, the first end portion of the lever may be configured to at least partially cover the first opening when the lever is in the second position. The first end portion of the lever may be configured to uncover the first opening when the lever is in the first position.

In aspects, the reservoir may include a second opening in communication with the elongate channel. The first and second openings may be defined in opposite ends of the reservoir.

In aspects, the dispenser may further include a lid disposed on the reservoir. The lid may be configured to selectively cover the elongate channel.

In aspects, the dispenser may be configured for receipt in a tank of the flush toilet.

In aspects, the float may be configured to rise and fall with a changing water level in the tank such that the float moves the lever from the first position to the second position and back to the first position during a flushing of the flush toilet.

In accordance with further aspects of the present disclosure, a dispenser for dispensing a cleaning tablet into a flush toilet is provided and includes a reservoir for slidably receiving a plurality of cleaning tablets, a lever pivotably coupled to the reservoir, and a float coupled to the lever. The lever has a first end portion configured to engage an end-most cleaning tablet of the plurality of cleaning tablets. The float is configured to pivot the lever between a first position and a second position in response to a flushing of the flush toilet. The lever is configured to dispense the end-most cleaning tablet upon moving toward the second position.

In aspects, the dispenser may further include a biasing member and a support wall. The biasing member may be configured to urge the plurality of cleaning tablets toward the lever. The support wall may be aligned with a first opening defined in a first end portion of the reservoir. The biasing member and the support wall may be configured to capture the end-most cleaning tablet therebetween.

In aspects, the float may have a buoyant force greater than a spring force of the biasing member such that the float is configured to overcome a friction force between the support wall and the end-most cleaning tablet to urge the end-most tablet relative to the support wall when the float rises with a rising water level in the flush toilet.

In aspects, the dispenser may include another support wall attached to the first end portion of the reservoir. The lever may be pivotably coupled to the two support walls.

In aspects, the plurality of cleaning tablets may have a plurality of spaces or blank tablets interspersed with the plurality of cleaning tablets.

In aspects, the plurality of cleaning tablets may include a first set of tablets that contain a sanitizing agent and a second set of tablets devoid of a sanitizing agent.

As used herein, the terms parallel and perpendicular are understood to include relative configurations that are substantially parallel and substantially perpendicular up to about + or −15 degrees from true parallel and true perpendicular.

BRIEF DESCRIPTION OF THE DRAWINGS

The present disclosure will become more readily apparent from the specific description accompanied by the following drawings, in which.

DETAILED DESCRIPTION

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "top" and "bottom" are relative and used only in the context to the other, and are not necessarily "superior" and "inferior."

The present disclosure generally provides a sanitizing tablet dispenser configured for use within a tank of a flush toilet. The dispenser detachably couples to the tank and includes a horizontally-disposed reservoir for slidably supporting a plurality of sanitizing tablets, a temporary holding chamber for holding an end-most tablet, and a lever having a float that rises and falls with a water level in the tank. The lever has a wedge that moves into the temporary holding chamber in response to the float rising with a rising water level to push the end-most tablet out of the temporary holding chamber. Upon the water level receding, and the float falling in response, the wedge of the lever moves out of the temporary holding chamber. With the wedge no longer blocking the temporary holding chamber, a biasing member (e.g., a spring) slides the tablets through the reservoir to position the next end-most tablet into the temporary holding chamber. The force exerted on the tablets by the biasing member causes the end-most table to be captured between a support wall of the chamber and the biasing member to prevent the end-most tablet from falling out of the chamber. These and other advantageous of the presently disclosed dispenser will be further elucidated herein.

Figure 1:
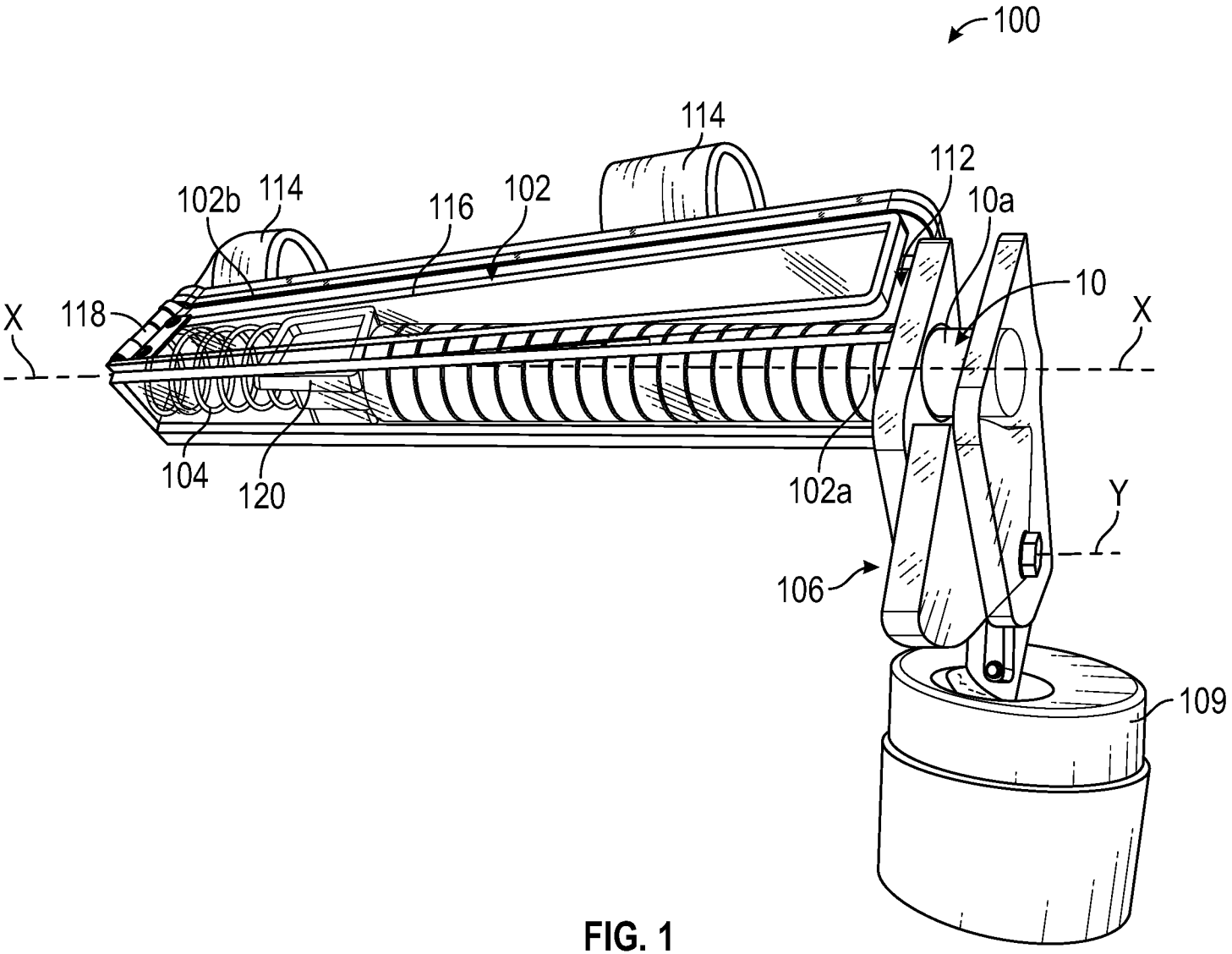
FIG. 1 is a perspective view illustrating an exemplary embodiment of a sanitizing tablet dispenser for use in a flush toilet.

With reference to FIG. 1, an exemplary dispenser 100 for attachment to a tank of a standard flush toilet is illustrated. In aspects, the dispenser 100 may be configured for receipt in the tank while being attached to an outer wall of the tank. The dispenser 100 is configured to selectively dispense a sanitizing tablet 10 with each flush of the flush toilet to maintain the bowl and tank of the flush toilet in a sanitary condition. The tablets 10 may be chlorine tablets, detergent tablets, or any other suitable cleaning agent-containing tablets designed to sanitize surfaces and/or water to kill bacteria, viruses, etc. commonly present in a toilet bowl. The tablets 10 are illustrated as being disc-shaped, but it is contemplated that the dispenser 100 may be used to dispense tablets of any suitable shape, such as cube-shaped, wafer-shaped, or the like. It is contemplated that the dispenser may be designed for use with tablets having any suitable thickness.

The dispenser 100 generally includes an elongated reservoir 102, a biasing member 104, a lever or arm 106, and a float 109. The reservoir 102 includes a first end portion 102*a* and an opposite second end portion 102*b* and defines a longitudinal axis "X" between the first and second end portions 102*a*, 102*b*. The first end portion 102*a* defines an opening 108 (FIG. 3) therein, which functions as an exit for an end-most tablet 10*a* of the sanitizing tablets 10. The second end portion 102*b* of the reservoir 102 may be closed or define an opening therein.

The reservoir 102 defines an elongated channel 112 therein that is in communication with the first opening 108. The channel 112 is sized to permit the slidable passage of the tablets 10 therethrough. The reservoir 102 is configured to be attached to the tank of the flush toilet such that the longitudinal axis "X" of the reservoir 102 is perpendicular to the direction of gravity (e.g., parallel with a ground). The reservoir 102 may include one or more attachment members 114, such as, for example, hooks, latches, or the like, configured to detachably couple to an outer wall of the tank. In aspects, the reservoir 102 may be fastened to the tank of the flush toilet.

The reservoir 102 may have a lid 116 that covers the elongate channel 112 to enclose the tablets 10 in the reservoir 102. The lid 116 may be elongated and pivotably coupled to the second end portion 102*b* of the reservoir 102 via a hinge 118. As such, the lid 116 may be pivoted between an opened state to allow for easy loading of the tablets 10 into the channel 112 and a closed stated to enclose the tablets 10 in the reservoir 102. In aspects, the reservoir 102 may be devoid of a lid or cover.

The biasing member 104 of the dispenser 100 may be received in the channel 112 of the reservoir 102 behind the tablets 10. The reservoir 102 may further include a slidable block 120 (FIGS. 1 and 4) disposed within the channel 112 and between the biasing member 104 and the tablets 10. In aspects, the block 120 may be fixed to an end of the biasing member 104. The biasing member 104 may be held between the second end portion 102*b* of the reservoir 102 (e.g., via a ledge or stop) and the block 120 and is configured to exert a bias on the block 120 and, in turn, the tablets 10, in a direction oriented toward the first opening 108. In other aspects, the biasing member 104 may be a flexible band (e.g., rubber) attached to the block 120 at one end and the lid 116 or other suitable portion of the dispenser 100 at another end of the band. Other suitable types of biasing members are also contemplated.

Figure 2:
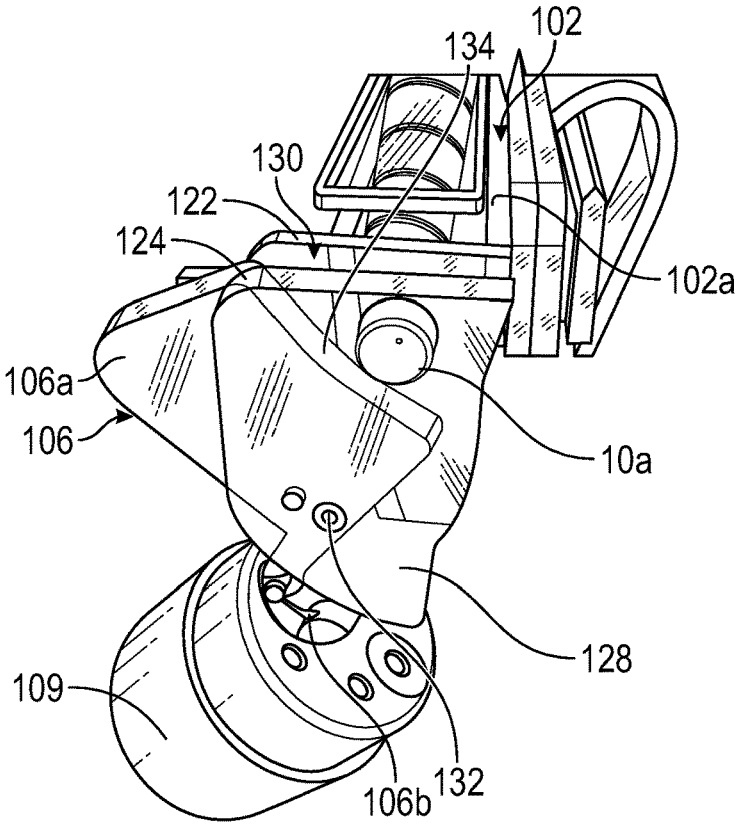
FIG. 2 is a is a side, perspective view illustrating the dispenser of FIG. 1.
Figure 3:
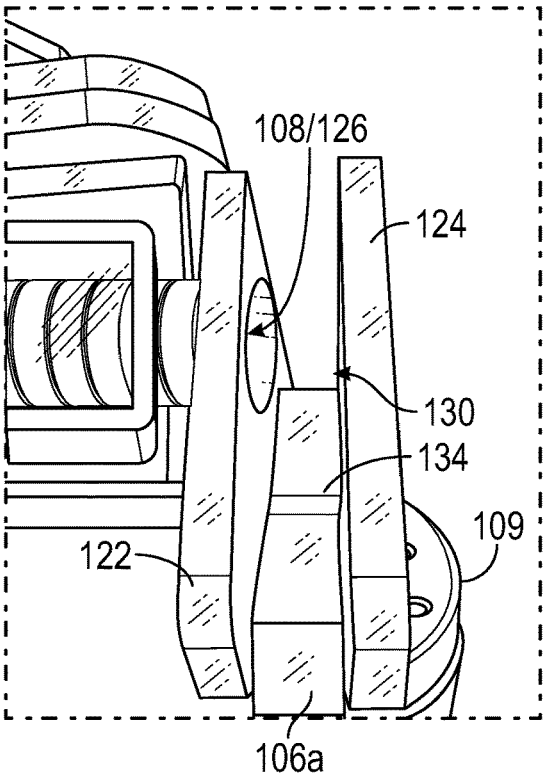
FIG. 3 is a top, perspective view illustrating a temporary holding space or chamber of the dispenser of FIG. 1.

With reference to FIGS. 2-3, the dispenser 100 further includes a pair of spaced-apart walls 122, 124 coupled to the first end portion 102*a* of the reservoir 102 and extending downwardly (e.g., perpendicularly). The first wall 122 is directly attached to the first end portion 102*a* of the reservoir 102 and defines an opening 126 (FIG. 3) that is coextensive with the opening 108 in the first end portion 102*a* of the reservoir 102. The second wall 124 is aligned with the longitudinal axis "X" (FIG. 1) of the reservoir 102 and spaced from the first wall 122 at a distance substantially equal to a thickness of a tablet 10. The first and second walls 122, 124 may be attached to one another or monolithically formed with one another at a junction 128. The walls 122, 124 may cooperatively define a generally U-shaped space 130 configured for movable receipt of the lever 106 and the end-most tablet 10*a* (e.g., the tablet 10*a* closest to the first end portion 102*a* of the reservoir 102). The biasing member 104 (FIG. 1) and the second wall 124 are configured to capture the end-most cleaning tablet 10*a* in the space 130 to resist the end-most tablet 10*a* from moving out of the space 130 via gravity.

The lever or arm 106 is pivotably coupled to the junction 128 of the first and second walls 122, 124 and includes a first end portion 106*a* and a second end portion 106*b*. The lever 106 may be pivotably coupled to the junction 128 via a pivot pin 132 at an intermediate portion of the lever 106. The first end portion 106*a* of the lever 106 may have a plate-like or flat shape configured to be slidably received in the space 130 defined between the walls 122, 124. The first end portion 106*a* of the lever 106 has an oblique edge surface 134 configured to engage and urge the end-most cleaning tablet 10*a* out of the space 130 to allow the tablet 10*a* to fall into the toilet tank via gravity. In aspects, the edge surface 134 may support the end-most tablet 10*a* thereon.

Figure 4:
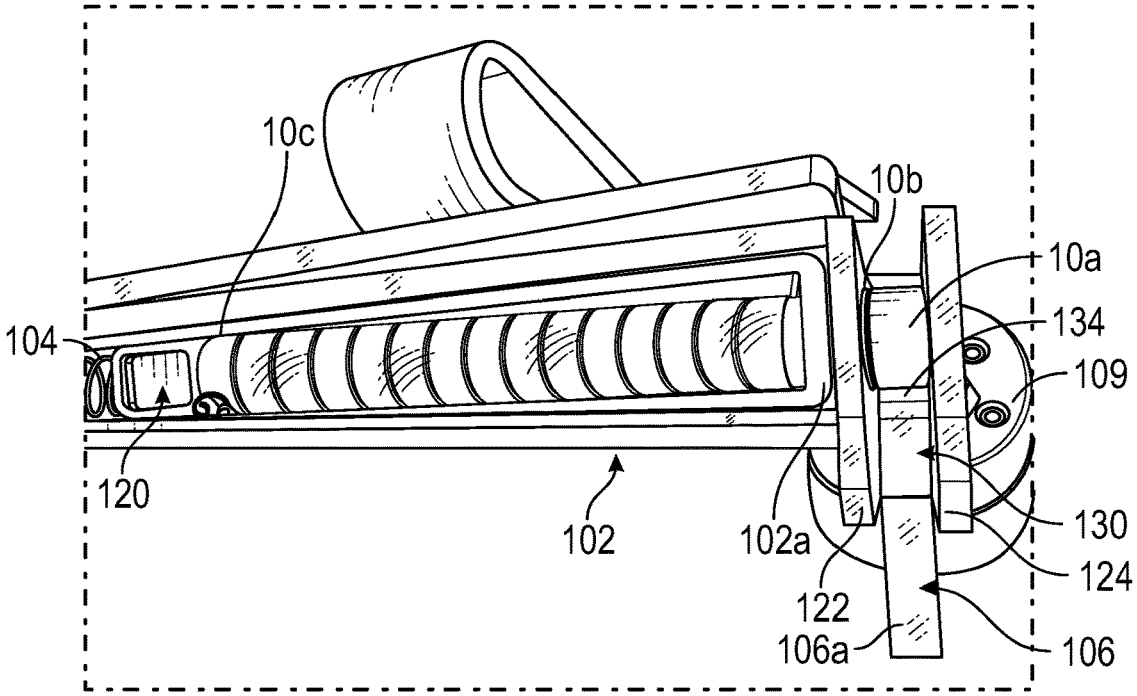
FIG. 4 is a top, perspective view of the dispenser of FIG. 1 with a lever in a first position.
Figure 5:
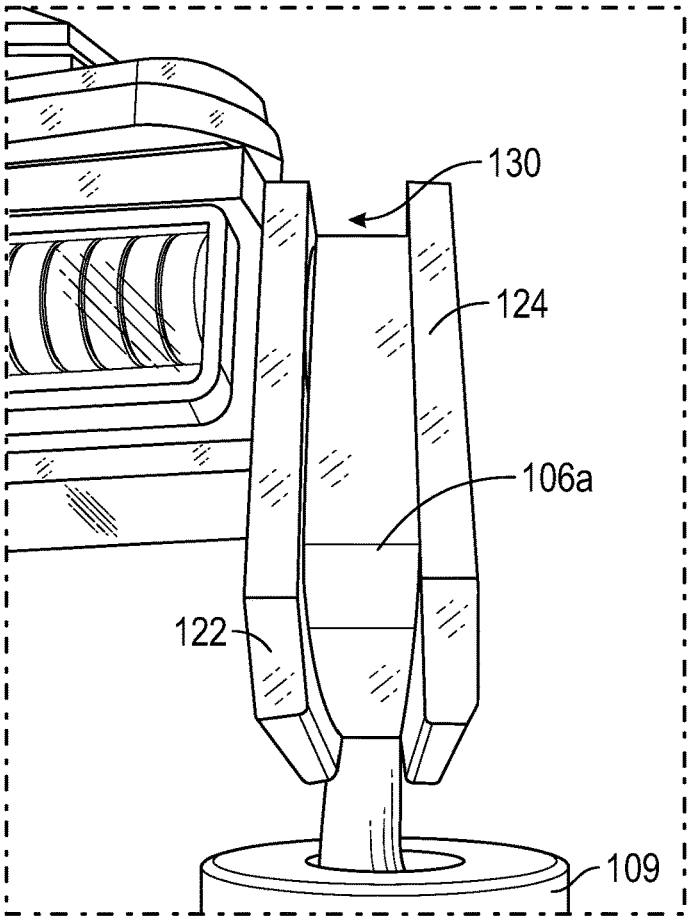
FIG. 5 is a top, perspective view illustrating the lever of FIG. 4 in a second position.

The lever 106 is configured to pivot about a pivot axis "Y" (FIG. 1) between a first position (as shown in FIG. 4) corresponding to a low water of the water tank (e.g., pre-flush), and a second position (as shown in FIG. 5) corresponding to a high water of the water tank (e.g., during a flush). The first end portion 106*a* of the lever 106 is configured to cover the first opening 108/126 when the lever 106 is in the second position, and uncover the first opening 108/126 when the lever 106 is in the first position.

The float 109 is fixed to or otherwise coupled to the second end portion 106*b* of the lever 106 and is configured to move the lever 106 between the first and second positions in response to a flushing of the flush toilet. The float 109 may be any suitable shape (e.g., cylindrical, squared, flat, etc.) and may include any suitable buoyant materials (e.g., a plastic, rubber, foam, etc.). As such, the float 109 is configured to rise and fall with the water level in the tank during a flush cycle of the flush toilet. The float 109 is configured to have a buoyant force (e.g., based on the size and material selected for the float) greater than a spring force of the biasing member 104 so that the buoyant force of the float 109 overcomes the spring bias of the biasing member 104 to drive a pivoting motion of the lever 106 with sufficient torque to overcome a static friction present between the second wall 124 and the end-most tablet 10*a* and a second-to-last tablet 10*b* (FIG. 4) and the end-most tablet 10*a*.

During use, with reference to FIGS. 4 and 5, the dispenser 100 is installed in a tank of a flush toilet and the reservoir 102 is loaded with a plurality of cleaning tablets 10. The block 120 (FIGS. 1 and 4) is positioned behind the tablets 10 and engaged to a first tablet 10*c* (FIG. 4). Upon loading the tablets 10 into the reservoir 102, the biasing member 104 urges the tablets 10, via the block 120, toward the first end portion 102*a* of the reservoir 102 to position the end-most tablet 10*a* into the space 130 between the first and second walls 122, 124. The end-most tablet 10*a* is prevented from falling out of the space 130 due to the frictional engagement of the end-most tablet 10*a* between the second wall 124 and the second-to-last tablet 10*b*.

When the toilet is flushed (e.g., automatically or via a manual actuation by a user), the water level in the tank rises (as is conventional) to lift or raise the float 109. Since the float 109 is affixed to the lever 106, the float 109 pivots the lever 106 from the first position (FIG. 4) toward the second position (FIG. 5) by the upward buoyant force of the rising float 109. The first end portion 106*a* of the lever 106 slides through the space 130 between the walls 122, 124, whereby the edge surface 134 of the lever 106 urges the end-most tablet 10*a* out of the space 130 and out of engagement with the walls 122, 124. With the end-most tablet 10*a* captured within the space 130, gravity is permitted to drop the end-most tablet 10*a* into the tank.

In the second half of the flush cycle, the water level begins to fall, whereby the float 109 drives a pivoting motion of the lever 106 from the second position (FIG. 5) back to the first position (FIG. 4). As the lever 106 pivots back toward the first position (FIG. 4), the first end portion 106*a* of the lever 106 moves out of alignment with the opening 108/126 (FIG. 3) in the first end portion 102*a* of the reservoir 102. With the first end portion 106*a* of the lever out of alignment with the opening 108/126, the biasing member 104 pushes or slides the second-to-last tablet 10*b* (now the end-most tablet) into the space 130 and into frictional engagement with the second wall 124 to hold the tablet 10*b* in position in preparation for a future flush cycle.

It is contemplated that the plurality of tablets 10 may include a plurality of blank tablets (e.g., tablets devoid of a sanitizing agent) interposed between adjacent cleaning tablets for those instances where sanitizing the flush toilet with every flush may be considered excessive. In aspects, the blank tablets (or a space) may be present at random locations. In aspects, the blank tablets (or spaces) may be disposed adjacent one another so that the dispenser 100 dispense the sanitizing tablets only after multiple successive flushes.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A dispenser for dispensing a cleaning tablet into a flush toilet, the dispenser comprising:

a reservoir for holding a plurality of cleaning tablets;

a lever having a first end portion configured to engage an end-most cleaning tablet of the plurality of cleaning tablets, and a second end portion;

a biasing member configured to urge the plurality of cleaning tablets toward the first end portion of the lever; and a float coupled to the second end portion of the lever and configured to move the lever between a first position and a second position in response to a flushing of the flush toilet, wherein the lever is configured to dispense the end-most cleaning tablet upon moving toward the second position.

2. The dispenser according to claim 1, wherein the first end portion of the lever is further configured to support the end-most tablet when the lever is in the first position.

3. The dispenser according to claim 2, wherein the first end portion of the lever has an edge surface configured to engage and urge the end-most tablet when the lever moves to the second position.

4. The dispenser according to claim 1, wherein the biasing member is disposed in the reservoir.

5. The dispenser according to claim 1, further comprising a support wall disposed adjacent a first end portion of the reservoir, wherein the support wall and the first end portion of the reservoir define a space therebetween configured for receipt of the end-most cleaning tablet.

6. The dispenser according to claim 5, wherein the biasing member and the support wall are configured to capture the end-most cleaning tablet therebetween to resist the end-most tablet from moving out of the space.

7. The dispenser according to claim 6, wherein the float has a buoyant force greater than a spring force of the biasing member such that the float is configured to overcome the spring force of the biasing member to urge the end-most tablet out of the space when the float rises with a rising water level in the flush toilet.

8. The dispenser according to claim 1, wherein the lever is configured to pivot about a pivot axis between the first and second positions.

9. The dispenser according to claim 8, wherein the reservoir defines a longitudinal axis that is parallel with the pivot axis of the lever.

10. The dispenser according to claim 1, wherein the reservoir defines an elongate channel configured for slidable receipt of the plurality of cleaning tablets.

11. The dispenser according to claim 10, wherein the reservoir defines a first opening in communication with the elongate channel, the first opening being disposed adjacent the first end portion of the lever.

12. The dispenser according to claim 11, wherein the first end portion of the lever is configured to:

at least partially cover the first opening when the lever is in the second position; and uncover the first opening when the lever is in the first position.

13. The dispenser according to claim 1, wherein the dispenser is configured for receipt in a tank of the flush toilet.

14. The dispenser according to claim 13, wherein the float is configured to rise and fall with a changing water level in the tank such that the float moves the lever from the first position to the second position and back to the first position during the flushing of the flush toilet.

15. The dispenser according to claim 1, wherein the reservoir is configured to hold a first set of tablets of the plurality of cleaning tablets that contain a sanitizing agent and a second set of tablets of the plurality of cleaning tablets devoid of a sanitizing agent.

16. The dispenser of claim 1, wherein the float has a buoyant force greater than a spring force of the biasing member such that the float is configured to overcome the spring force of the biasing member to urge the end-most tablet away from the lever when the float rises with a rising water level in the flush toilet.

17. A dispenser for dispensing a cleaning tablet into a flush toilet, the dispenser comprising:

a reservoir for slidably receiving a plurality of cleaning tablets;

a lever pivotably coupled to the reservoir and having a first end portion configured to engage an end-most cleaning tablet of the plurality of cleaning tablets;

a biasing member configured to urge the plurality of cleaning tablets toward the lever; and a float coupled to the lever and configured to pivot the lever between a first position and a second position in response to a flushing of the flush toilet, wherein the lever is configured to dispense the end-most cleaning tablet upon moving toward the second position.

18. The dispenser according to claim 17, further comprising a support wall aligned with a first opening defined in a first end portion of the reservoir, wherein the biasing member and the support wall are configured to capture the end-most cleaning tablet therebetween.

19. The dispenser according to claim 18, wherein the float has a buoyant force greater than a spring force of the biasing member such that the float is configured to overcome a friction force between the support wall and the end-most cleaning tablet to urge the end-most tablet relative to the support wall when the float rises with a rising water level in the flush toilet.

20. The dispenser according to claim 17, wherein the reservoir is configured to hold a plurality of spaces or blank tablets interspersed with the plurality of cleaning tablets.

* * * * *